US011149932B1

(12) United States Patent
Kelly et al.

(10) Patent No.: US 11,149,932 B1
(45) Date of Patent: Oct. 19, 2021

(54) DEVICE WITH LIGHTING, LOCATION AND COMMUNICATION SYSTEMS

(71) Applicant: LIGHTUPTOYS.COM LLC, Sellersburg, IN (US)

(72) Inventors: Christopher D. Kelly, New Albany, IN (US); Joshua C. Kelly, Sellersburg, IN (US); Max Armendariz Lalama, Georgetown, IN (US); Ariel Macaulay Bruton, Louisville, KY (US)

(73) Assignee: LIGHTUPTOYS.COM LLC, Sellersburg, IN (US)

( * ) Notice: Subject to any disclaimer, the term of this patent is extended or adjusted under 35 U.S.C. 154(b) by 0 days.

(21) Appl. No.: 16/889,364

(22) Filed: Jun. 1, 2020

Related U.S. Application Data

(63) Continuation-in-part of application No. 15/982,405, filed on May 17, 2018, now Pat. No. 10,674,588, which is a continuation-in-part of application No. 14/750,896, filed on Jun. 25, 2015, now abandoned.

(51) Int. Cl.

| | |
|---|---|
| ***F21V 23/04*** | (2006.01) |
| ***F21V 23/00*** | (2015.01) |
| ***F21V 21/096*** | (2006.01) |
| ***F21V 3/04*** | (2018.01) |
| ***F21V 21/08*** | (2006.01) |
| ***F21W 131/30*** | (2006.01) |
| ***F21Y 115/10*** | (2016.01) |

(52) U.S. Cl.
CPC ..... *F21V 23/045* (2013.01); *F21V 3/049* (2013.01); *F21V 21/0816* (2013.01); *F21V 21/096* (2013.01); *F21V 23/005* (2013.01); *F21V 23/0471* (2013.01); *F21W 2131/30* (2013.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2014/0354153 | A1* | 12/2014 | Pulido, Jr. | B60Q 3/80 315/77 |
| 2015/0016093 | A1* | 1/2015 | Wilson | F21V 33/0008 362/103 |
| 2016/0100471 | A1* | 4/2016 | Van De Sluis | H05B 47/155 315/152 |
| 2017/0238401 | A1* | 8/2017 | Sadwick | F21V 21/15 315/294 |

* cited by examiner

*Primary Examiner* — Crystal L Hammond
(74) *Attorney, Agent, or Firm* — Scott R. Cox; Jessica C. Ronald

(57) ABSTRACT

An illuminating pendant that includes a housing unit, one or more layers of translucent material connected to the housing unit, and control circuitry secured to the housing unit and electrically connected to one or more LEDs and to a power source. The control circuitry includes a receiver and a proximity detection device and detects a first signal location proximate to a first proximity beacon and illuminates one or more LEDs in a pattern associated with the first signal location. In one embodiment the illuminating pendant is affixed to a wearable band. In another embodiment, the illuminating pendant is magnetically secured to a user's clothing.

20 Claims, 18 Drawing Sheets

DEVICE WITH LIGHTING, LOCATION AND COMMUNICATION SYSTEMS

CROSS REFERENCE TO RELATED APPLICATION

This application is a continuation-in-part of and claims priority to U.S. Ser. No. 15/982,405, filed May 17, 2018, which application is a continuation-in-part that claims priority to U.S. Ser. No. 14/750,896 filed on Jun. 25, 2015.

FIELD OF THE INVENTION

The present device relates to the field of entertainment devices, more particularly, to the field of entertainment devices that are wearable and utilize electronics, lighting, location, and communication system(s).

BACKGROUND

There is a need for devices that are worn by a user that utilize electronics, and lighting, location, and communication systems to activate certain electronic features of the device when coming into close proximity with a sender. There is also a need for devices that are worn by a user that act as the signal sender to other devices when they come into close proximity to displays that contain a receiver.

SUMMARY OF INVENTION

There is disclosed an illuminating pendant that includes a housing unit, one or more layers of translucent material connected to the housing unit, and control circuitry secured to the housing unit and electrically connected to one or more LEDs and to a power source. The control circuitry includes a receiver and a proximity detection device and detects a first signal location proximate to a first proximity beacon and illuminates one or more LEDs in a pattern associated with the first signal location.

In one embodiment the illuminating pendant is affixed to a wearable band. In another embodiment, the illuminating pendant is magnetically secured to a user's clothing.

DETAILED DESCRIPTION OF DRAWINGS

Figure 7:
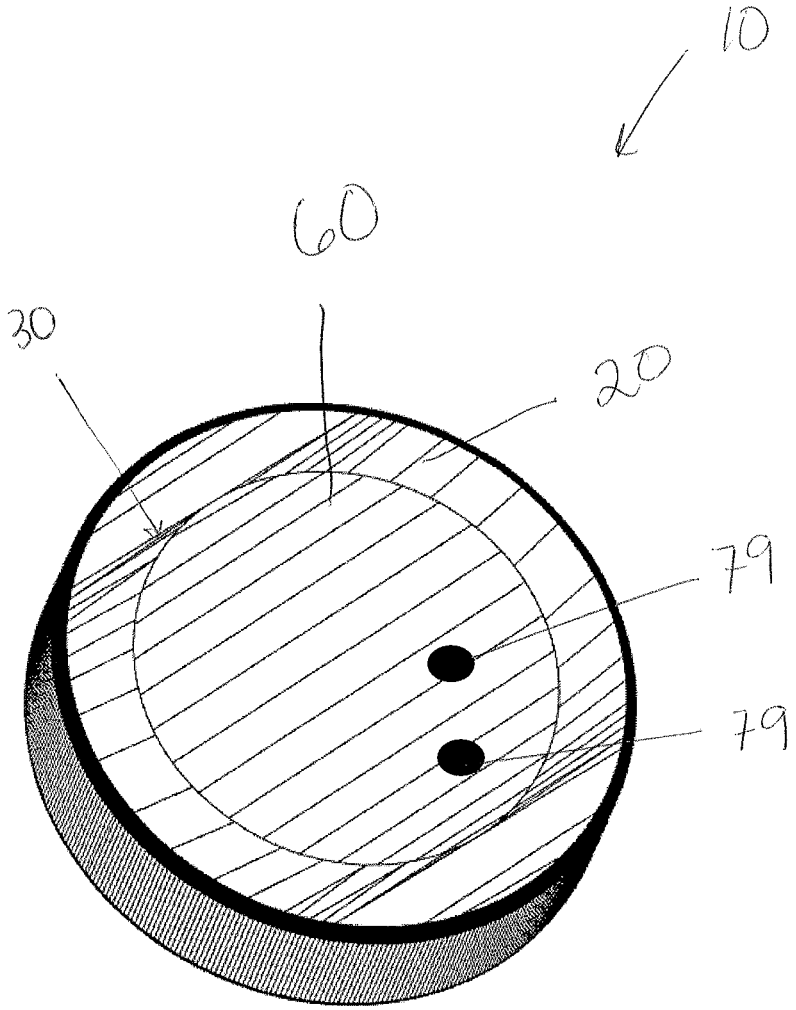
FIG. 7 is a top, perspective view of the illuminating pendant of FIG. 1 with conductive pins.
Figure 8:
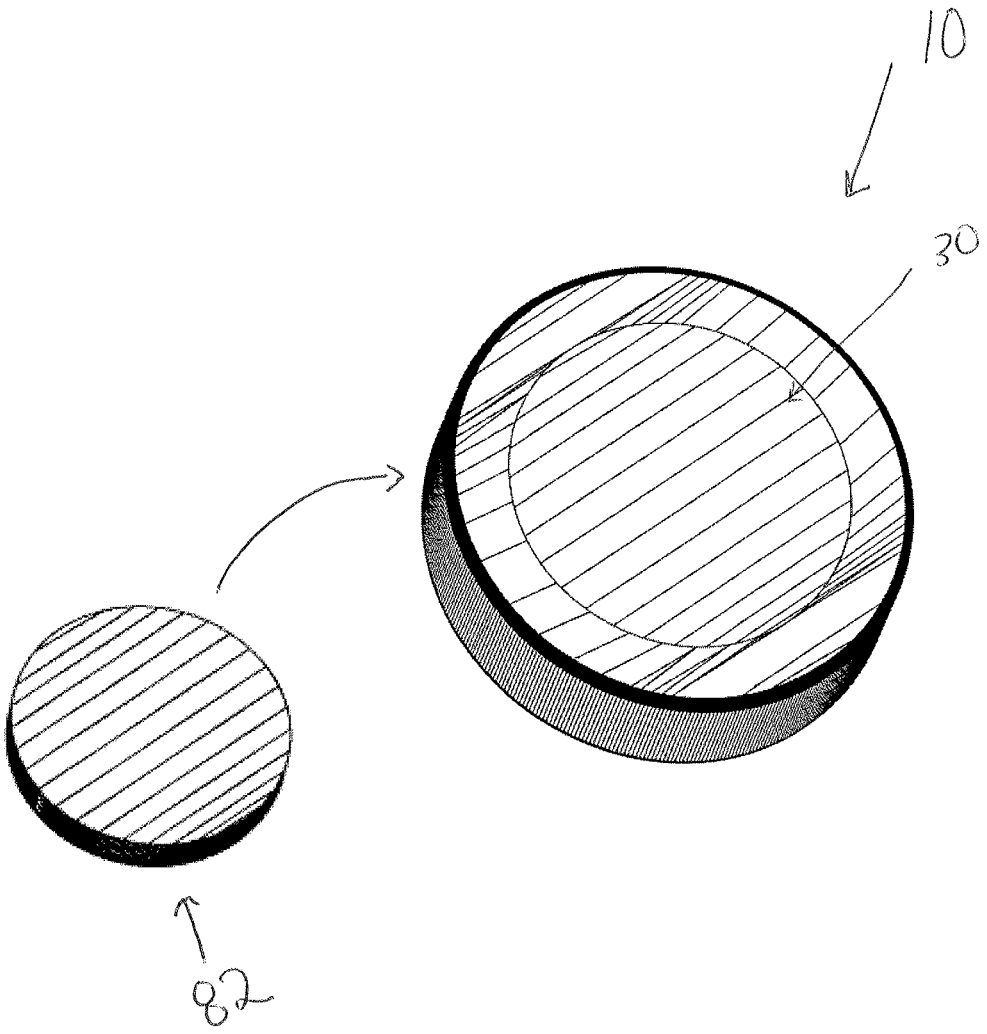
FIG. 8 is a top perspective view of the illuminating pendant of FIG. 1 with a magnet for securing the pendant.
Figure 9:
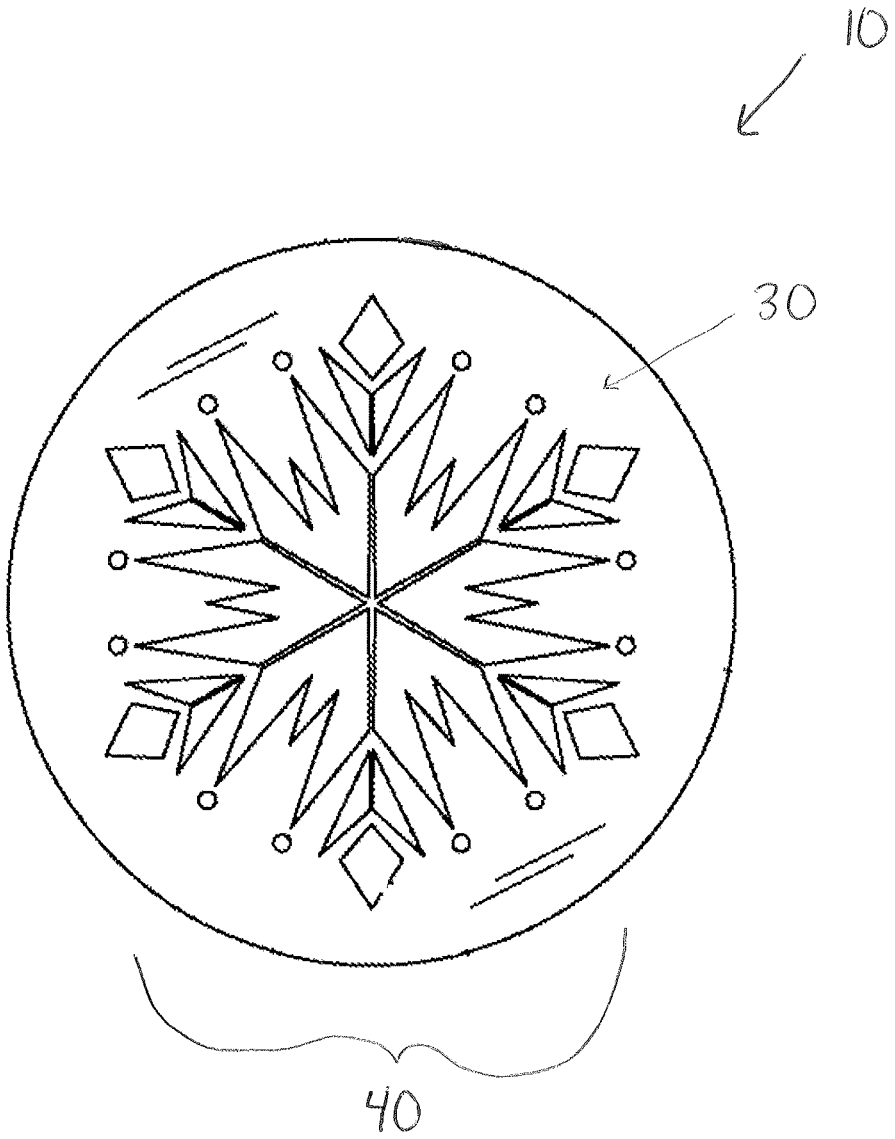
FIG. 9 is a front view of a face of the pendant of FIG. 1 when illuminated.
Figure 10:
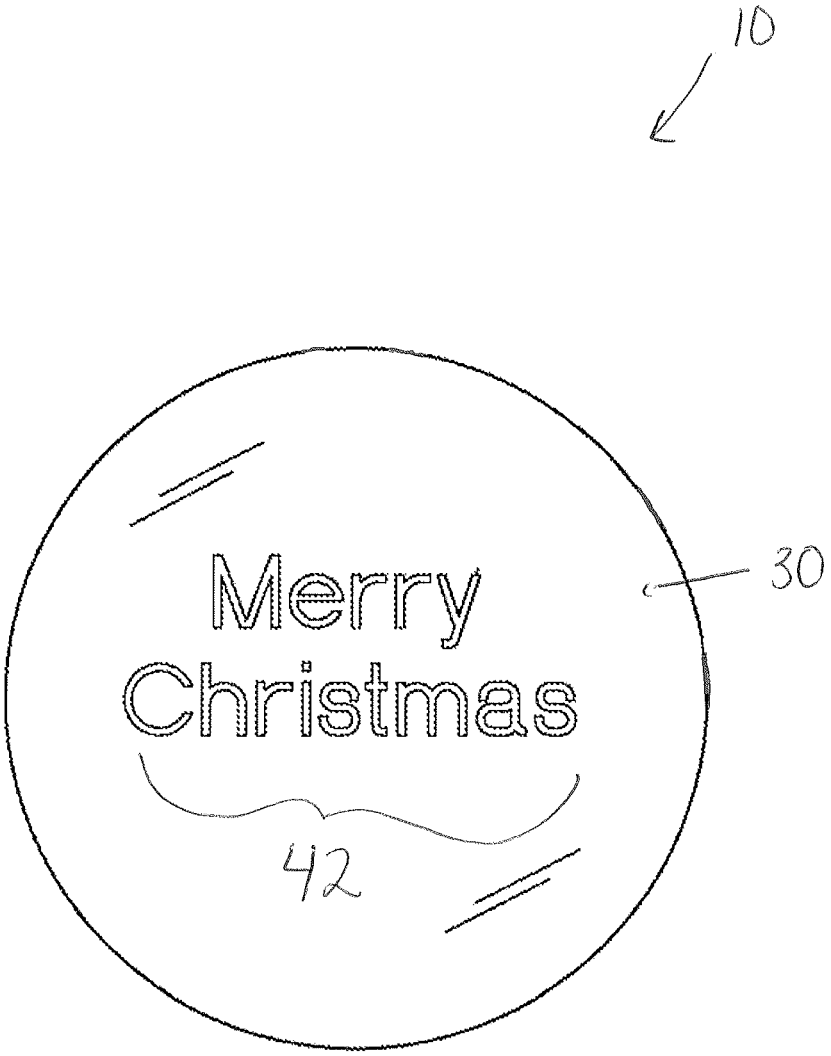
FIG. 10 is an alternative face of the pendant of FIG. 1 when illuminated.
Figure 11:
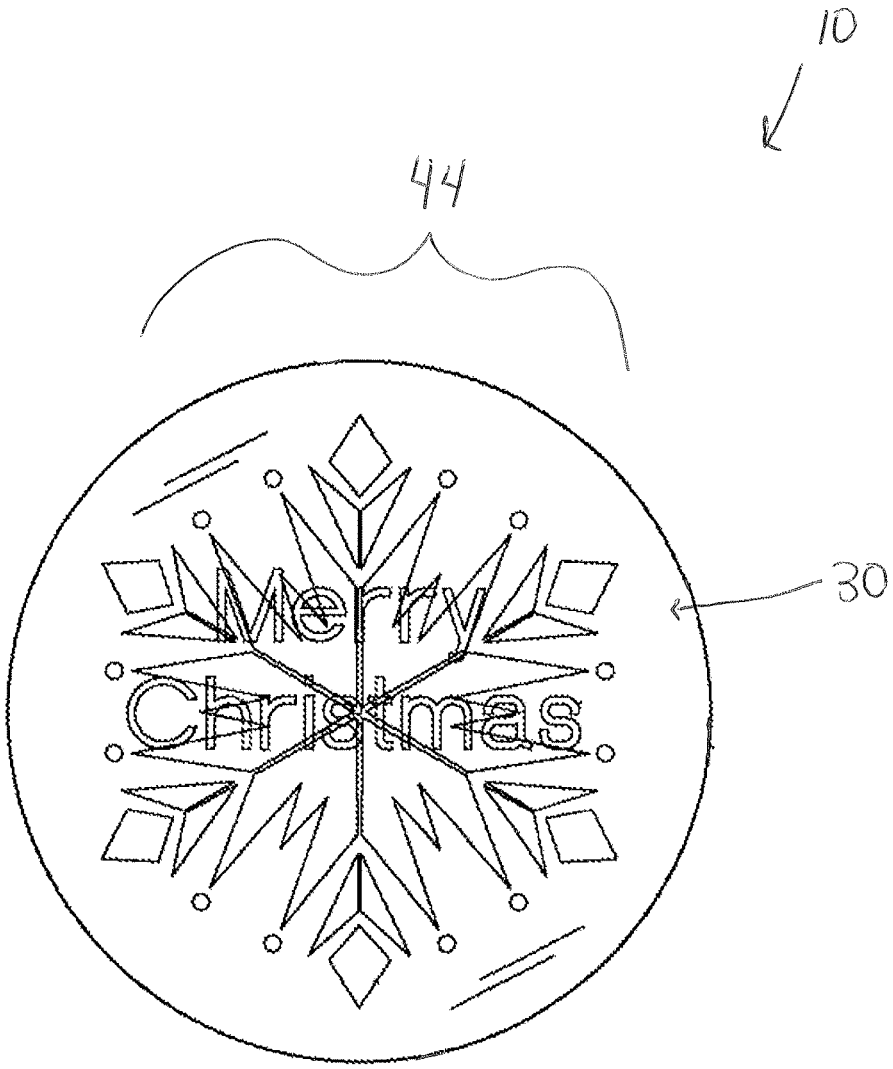
FIG. 11 is a front view of a transition face of the pendant of FIG. 1 between the image of FIG. 9 and the image of FIG. 10.
Figure 12:
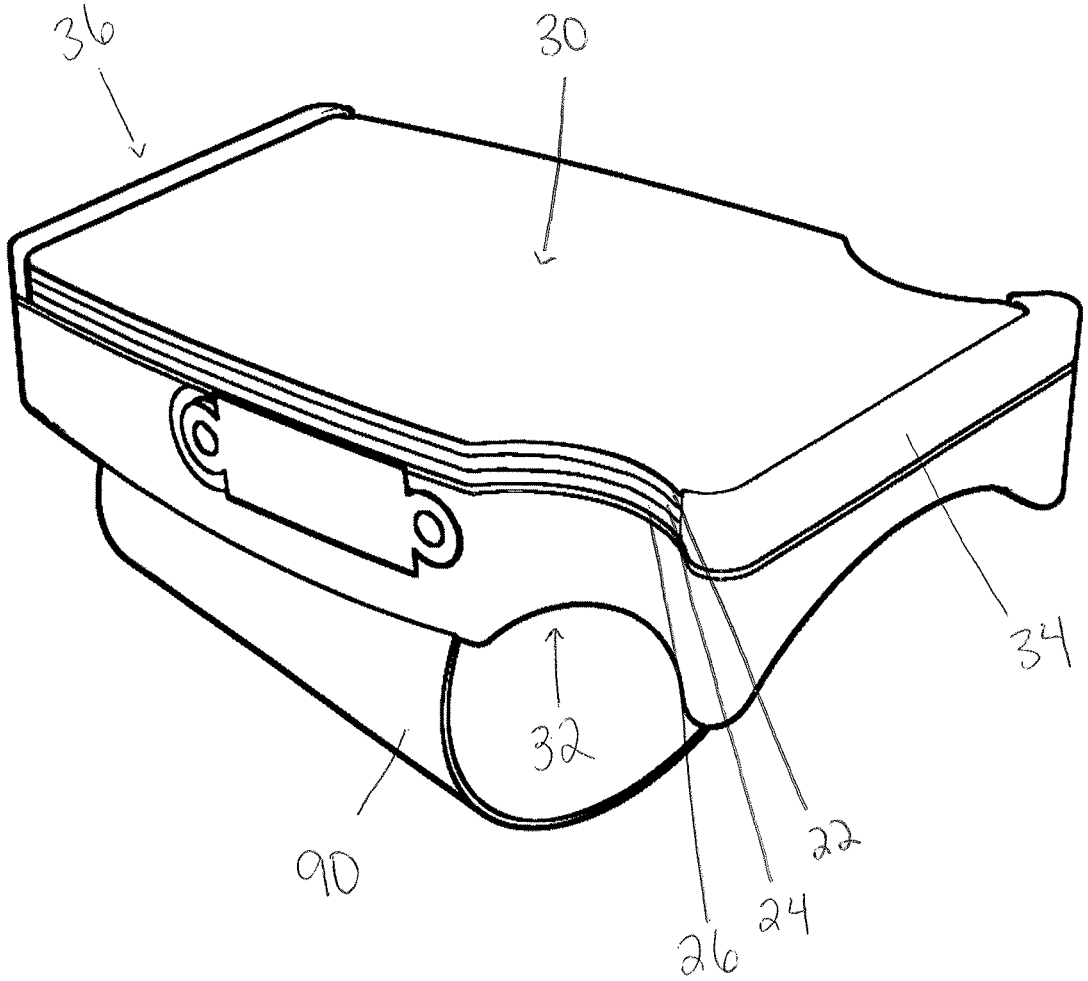
FIG. 12 is a side, perspective view of a second embodiment of an illuminating pendant affixed to a wearable band.

FIGS. 1-18 illustrate various implementations and components of an illuminating pendant 10 in various embodiments. FIGS. 1-8 illustrate an illuminating pendant that includes a centrally located housing unit 60 surrounded by one or more layers of translucent material 20. FIG. 8 illustrates the illuminating pendant being capable of magnetically connecting to a user's clothing via a first magnet (not shown) and a second magnet 82. FIGS. 9-11 illustrate a front face 30 of the illuminating pendant, wherein the one or more layers of translucent material include images (40, 42) etched into the one or more layers of translucent material and the layers encompass the entire front face of the illuminating pendant. FIGS. 12-18 illustrate the illuminated pendant affixed to a wearable band 90. In this implementation, the housing unit is covered entirely by the one or more layers of translucent material, so the one or more layers of translucent material encompass the entire front face of the pendant. Although the pendant is shown in a circular shape in FIGS. 1-11, the pendant can be any shape, as illustrated in FIGS. 12-18 or size depending on desired specifications. Although the way in which the pendant is worn by a user varies, and the configuration of the one or more layers of translucent material in relation to the housing unit varies, the general structural components of the illuminated pendant are consistent throughout the embodiments described herein and should be interpreted as applying to each embodiment.

The illuminating pendant 10 shown in FIGS. 1, 7-8 and 9-18 includes a housing unit 60 that comprises control circuitry that is electrically connected to a power source and one or more LEDs 50. The one or more LEDs are associated with one or more layers of translucent material 20, which layers are connected to the housing unit. Through illumination of the one or more LEDs associated with the one or more layers of translucent material, the illuminated pendant displays illuminated images and animation.

Figure 1:
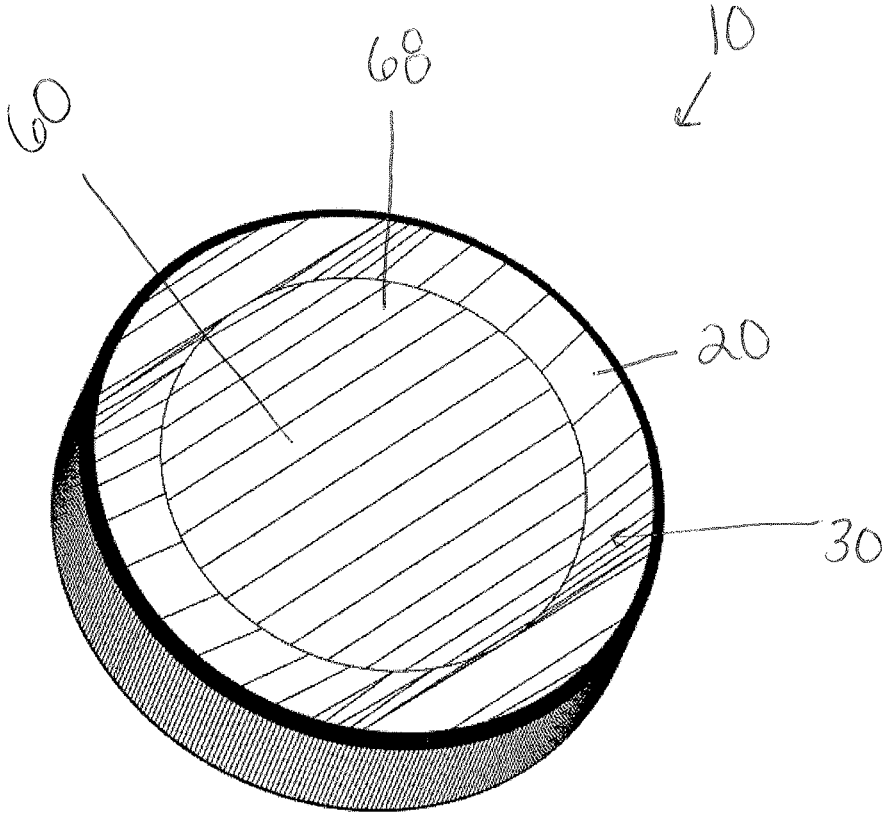
FIG. 1 is a top perspective view of one embodiment of an illuminating pendant with a housing unit surrounded by layers of translucent material.
Figure 2:
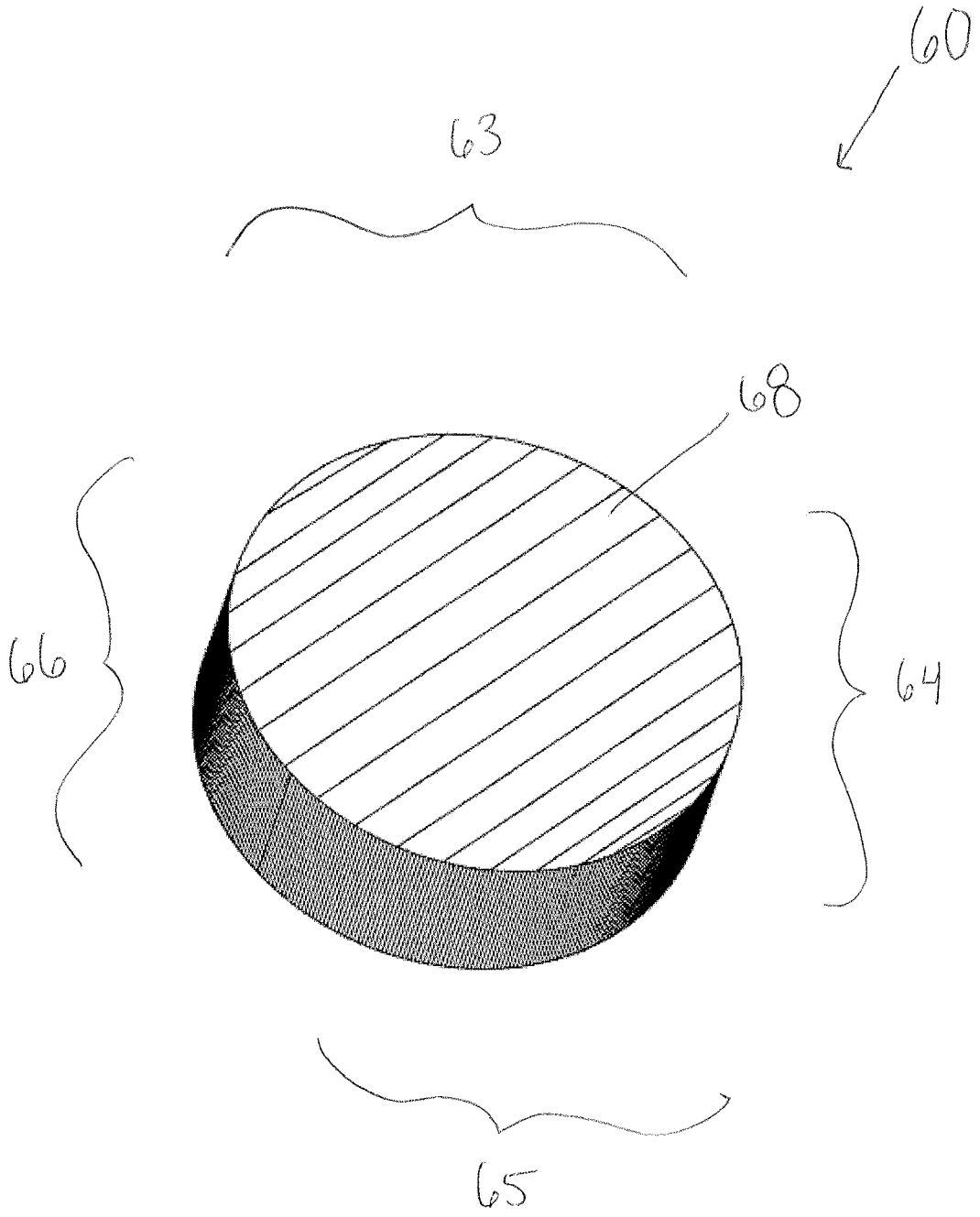
FIG. 2 is a top perspective view of the housing unit of FIG. 1.
Figure 3:
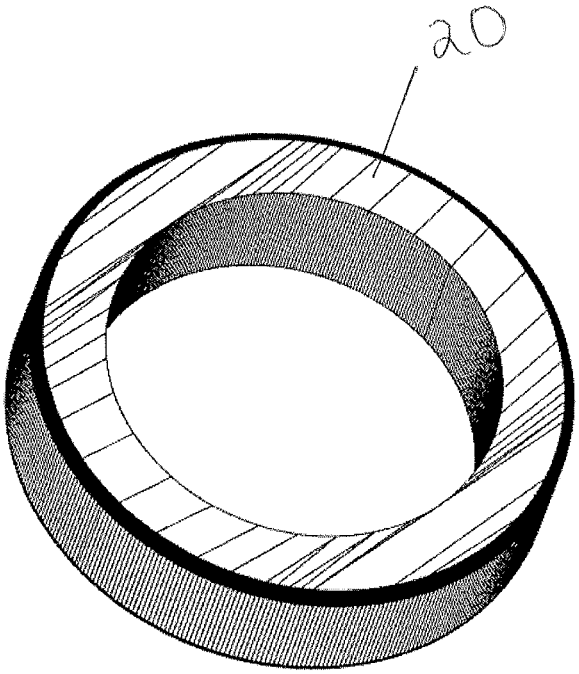
FIG. 3 is a top perspective view of the layers of translucent material of FIG. 1.

The pendant 10 is made of any material but is preferably made of plastic that is durable and can withstand being dropped. As shown in FIGS. 1, 7-11, and 12-17, the pendant includes a front face 30, a rear face 32, and sides 34, 35 36, 37. As shown in FIGS. 1 and 7-8, the front face of the illuminating pendant includes a centrally located housing unit 60 surrounded by one or more layers of translucent material 20. As shown in FIGS. 9-17, the front face is encompassed by one or more layers of translucent material. The one or more layers can be connected to any portion of the housing unit and in any configuration and each layer is constructed of a translucent or transparent material capable of transmitting and/or radiating light. For example, in some embodiments, the translucent material includes, but is not limited to, glass, plexiglass, acrylic, resin, and/or a combination thereof. The pendant can illuminate though the front face, the back face and/or through the sides of the pendant. Moreover, certain portions of the pendant may be constructed of an opaquer material to direct the light from the one or more LEDs 50 to shine through more prominently from select areas of the pendant. There can be multiple one or more layers of translucent material configured throughout the pendant. Moreover, the front face and/or layers of translucent material may be interchangeable.

As shown in FIGS. 9-11, the layers of the translucent material 20 include light reflective images 40, 42 contained in and/or on the translucent material. These images are achieved through etching, sandblasting, molding, engraving, imprinting, ingraining, cutting, impressing and/or outlining into or on the translucent material forming a light radiating portion. Further, such images are produced by embedding other reflective, refractive or other material within the layer. For example, the layers are molded with specific placement of a refractive material contained therein. Also, for example, the material is molded first and then laser etched. Alternatively, each layer is produced separately, images positioned or formed thereon and then combined later. Although generally referred to herein as "images" this is not to be understood as limiting, as the image may be text (e.g. "Merry Christmas"), logos, slogans, characters, and/or other visual content. For example, the pendant 10 includes three layers of translucent material that are connected collinearly to form a combined piece of translucent material. A first image is etched into the first layer, a second image is etched into the second layer and a third image is etched into the third layer etc. The one or more LEDs 50 associated with the layers of translucent material create an appearance of animation between images located on each layer. As displayed in FIG. 9, the pendant includes a first image 40, a snowflake, illuminated and visible on the front face 30 of the pendant. In contrast, in FIG. 10, the pendant includes a second image 42, the text "Merry Christmas", which is also illuminated and visible on the front face of the pendant. FIG. 11 illustrates the transition period 44 between the first image and the second image where both images may be visible of the front face of the pendant. In some embodiments, the transition period between the first image and the second image illustrated in FIG. 11 may be quite brief, for example a fraction of a second, in order to provide an appearance of animated movement between the two or more illustrated images.

Figure 13:
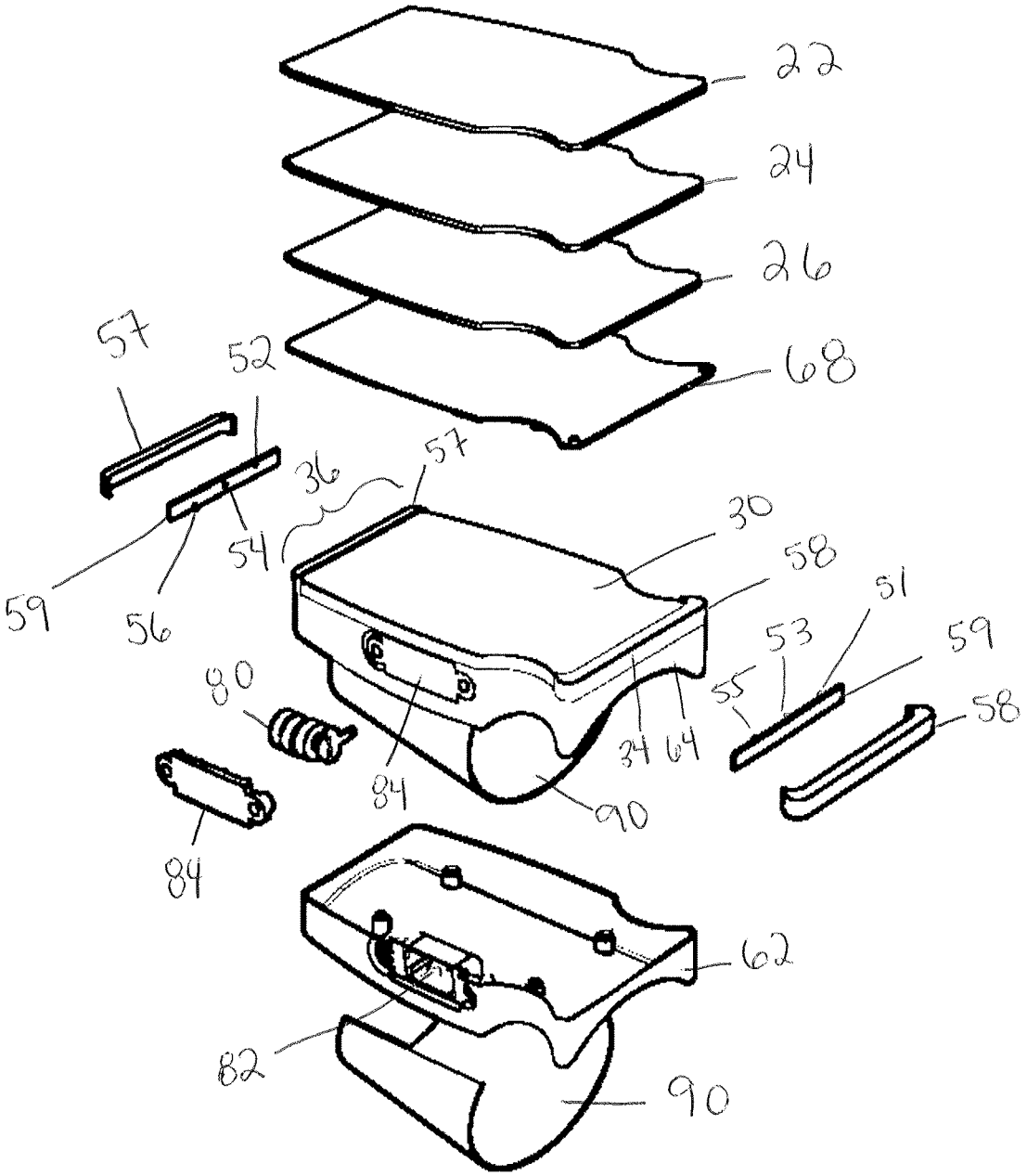
FIG. 13 is a side, perspective exploded view of the illuminating pendant affixed to the wearable band of FIG. 8.
Figure 14:
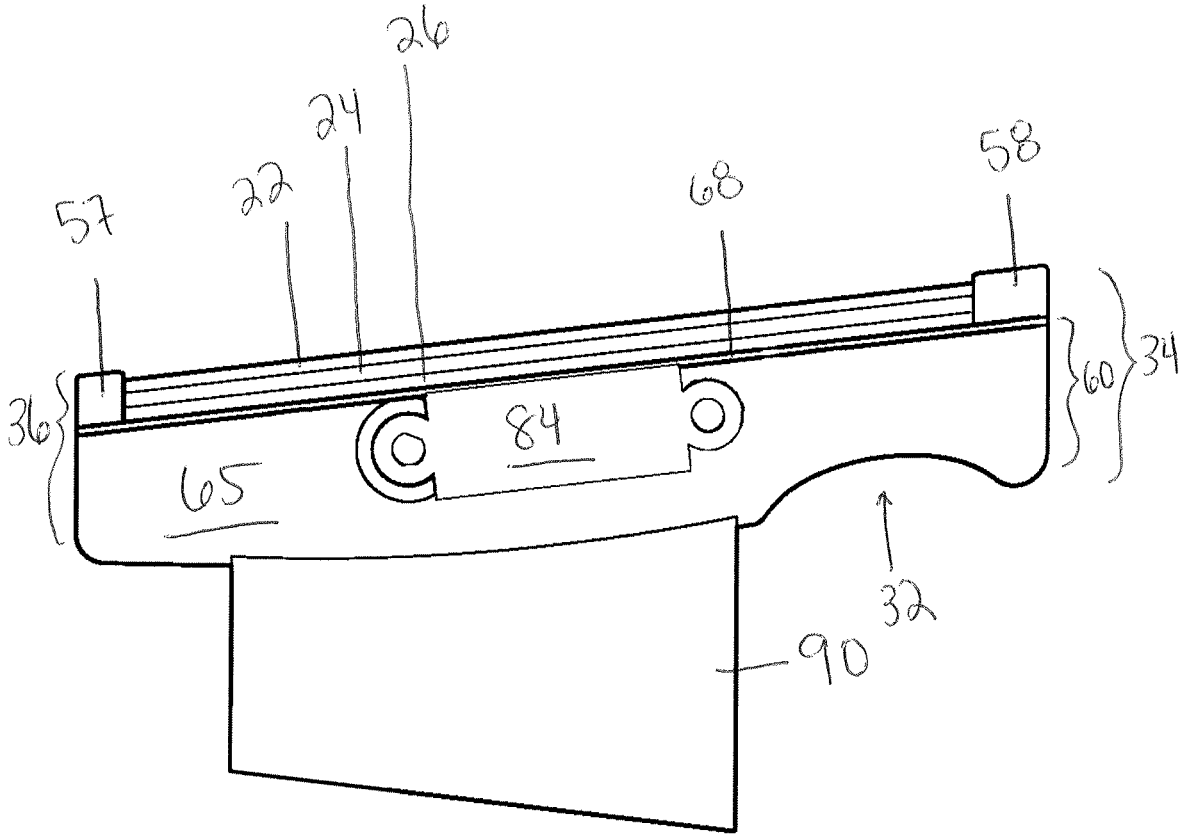
FIG. 14 is a side view of the illuminating pendant affixed to the wearable band of FIG. 12.

The one or more LEDs 50 are associated with the one or more layers 20 in different configurations depending on the location of the one or more layers in relation to the housing unit 60. For example, as shown in FIGS. 12-18, the one or more layers cover the housing unit in a configuration covering the entire front face 30 of the pendant 10. As shown in FIG. 13, each horizontal side 34, 36 of the pendant include three LEDs 52, 54, 56 and 51, 53, 55. These LEDs are secured for instance via covers 57, 58 that screw into the horizontal ends of the layers of translucent material. These covers also combine the three layers of translucent material into one colinear piece of translucent material and secure the layers to the housing unit. As shown in FIG. 13, the LEDs are secured to bars 59 at varying heights to correspond with the respective translucent layer. The LEDs can be different colors and size. Accordingly, the first layer 22 of translucent material is connected to or positioned adjacent of a first LEDs 51, 52, which are designed to be used in connection with illumination of the first layer of material. Similarly, the second layer of material 24 is connected to or positioned adjacent to second LEDs 53, 54 which are designed to be used in connection with the second layer of translucent material. Similarly, the third layer of material 26 is connected to or positioned adjacent to third LEDs 55, 56 which are designed to be used in connection with the third layer of translucent material. These LEDs direct light into or through the layers of translucent materials. By using each LED either alone or in combination with their respective layers, illumination affects are created by switching between the LEDs. Moreover, the LEDs associated with each layer can be integrated into the layers of translucent material by cutting a hole into each layer or by forming an opening during molding, in which each LEDs are placed. The sides are then covered with a non-translucent material, i.e., the bars, so that most of the light emitted from the LEDs is transmitted through the corresponding layer of translucent material.

To ensure illumination of each layer shines through the front face 30 of the pendant, the first layer of material 22 has a known refractive index positioned adjacent to a second different layer 24 of material having a refractive index different than the first layer. Similarly, additional layers of material can be used with similar or different material characteristics as the first or the second layer or have unique illumination characteristics itself. In such a manner, light entering the respective layer is controlled and prevented, promoted or partially allowed to transmit into an adjacent layer. Images can be etched into each layer (not shown), which illuminate with the respective LEDs to show depth and dimension in the images in the layers to create an animation effect. Each layer of translucent material contains a separate and distinct image etched, engraved, imprinted, cut, impressed, or otherwise present on or in the material forming a light radiating portion. In some embodiments, this image contains one or more colors. The appearance of animation is created when a first LED illuminates a first image in a first layer of material, which then blends into a second image illuminated by a second LED by fading or dimming out the first image while simultaneously fading or dimming in the second image, for example by having each image illuminated at some proportion of the maximum brightness of the respective LED. Alternatively, one image is completely switched off (e.g. no LED illuminated) and another image completely switched on (e.g. LED illuminated) with no overlap in time.

Figure 4:
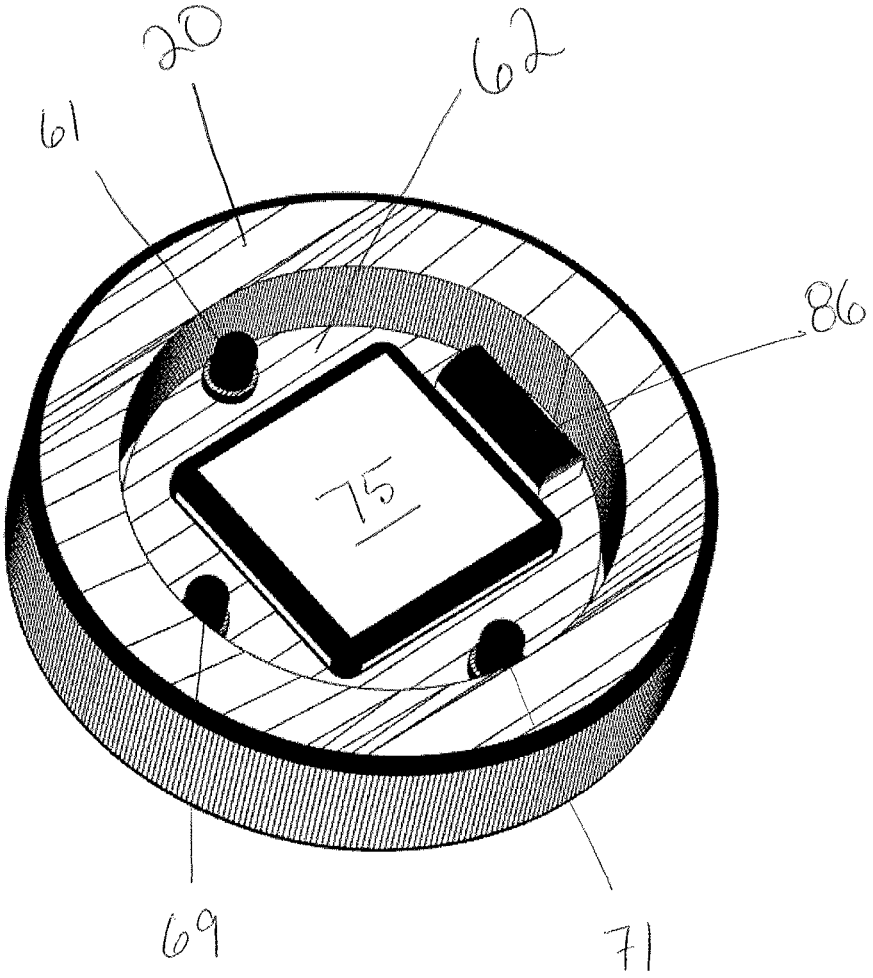
FIG. 4 is an inside view of the housing unit surrounded by the layers of translucent material of FIG. 1.

As shown in FIG. 4, the one or more LEDs 61, 69, 71 are housed within the housing unit 60 and then coupled with the layers 20 of the pendant 10. By coupled, it is meant that the LEDs are in illuminating engagement with the layers and not necessarily mechanically connected. Moreover, the one or more LEDs illuminate the housing unit through the front face 30 of the pendant. For example, the LEDs are positioned directly adjacent to an edge of the layers. In other examples, the LEDs are positioned directly adjacent to the layers and utilized directional optics to focus emitted light from the LEDs into the layers. Also, for example, the LEDs can be embedded within the layers and/or in combination therewith utilize reflective optics, reflectors, directional lenses and the like to implement illumination of the respective layer. In some embodiments, the LEDs are visible through the layers of translucent material. In this embodiment, for example and not shown, the first layer includes an image etched in a top portion of the ring of translucent material surrounding the housing unit and an LED 61 is associated with this first layer to illuminate the first image. A second layer includes an image etched in a middle portion of both sides of the ring and an LED 69 is associated with this second layer to illuminate the second image. A third layer includes an image etched in a bottom portion of the ring and an LED 71 is associated with this third layer to illuminate the third image. For instance, the first, second and third LED may be arranged at heights that correspond to the thickness and layer of translucent material for which they will be illuminating. When the LEDs associated with each layer illuminate, the images create a moving animation from a top portion of the pendant, to a middle portion, to a bottom portion. The images can be etched into any portion of the layers of translucent material.

In some embodiments, the pendant 10 further includes one or more electroluminescent wires, sheets, panels, which are used in addition to, or in place of, the LEDs 50. Similar to the LEDs, the one or more electroluminescent wires, sheets, panels, or tape, in some instances, are only used in connection with one layer of translucent material and are not be shared or used by any other layer of translucent material.

As shown in FIGS. 4-7, the housing unit 60 contains various control circuitry that controls and activates electrical components of the pendant 10. The one or more LEDs 50, 51, 52, 53, 54, 55, 56, 61, 69, 71 are controlled by circuitry such as a printed circuit board 74, or microprocessor 75 located within housing 60. Fine illumination control of the multiple layers is achieved including switching quickly between illumination of the images to provide full animation appearance. Although the creation of an appearance of animation is discussed in terms of a first image and second image this is not intended to be limiting, as there can be one, two, three, four, five or more images formed on separate or combined layers. For example, in some implementations, the respective layer includes a plurality of images, each of which react to or are illuminated by specific illumination characteristics of the LED. For example, a first material in the first layer is formed of a material that refracts, reflects or illuminates in light of a first predefined frequency. Further, a second material in the first layer is formed of a second material that reflects, refracts or illuminates in light of a second predefined frequency. By controlling the output characteristics of the LED in the first layer, the same layer illuminates two different images. Control of such illumination control characteristics includes control and modification of output frequency, color, modulation, and or intensity, to name a few aspects. Other known control characteristics can be modified in such implementation as well. In some examples, the lighting sequence produced by the LEDs are a chaser pattern, a blinking pattern, a fixed illumination of a constant brightness, and/or a variable illumination pattern.

As shown in FIGS. 1, 2, 4, and 12-18 the housing unit includes a base 62 with sides 63, 64, 65, 66 and a cover 68 that secures or seals to the sides of the base. As shown in FIGS. 1 and 4, the housing unit is secured centrally inside the layers of translucent material 20. FIGS. 12-18 show the housing unit secured underneath the layers of translucent material. The housing unit can be secured or connected to the layers of translucent material in any configuration.

As shown in FIGS. 4-7, the housing unit 60 contains various control circuitry that controls and activates electrical components of the pendant 10. Although not shown, the control circuitry is utilized with the illuminating pendant affixed to the wearable band 90 and the magnet 82. This circuitry is used to control the light patterns of the LEDs 50 for example, with a printed circuit board 74 that has an embedded LED controller which controls various characteristics of the LEDs in the pendant and/or in combination with the wearable band of FIGS. 12-18. In implementations, the control circuitry includes functional control of the LED intensity, color temperature, color, illumination duration and timing. Such control further includes control modulation such as, for example, frequency or amplitude modulation. The control of the light patterns is capable of being random or regular, or capable of being a controlled and continuous sequence or pattern, a custom sequence or pattern, and/or sequence or pattern that incorporates constant timing, variable timing, and/or dimming.

Figure 15:
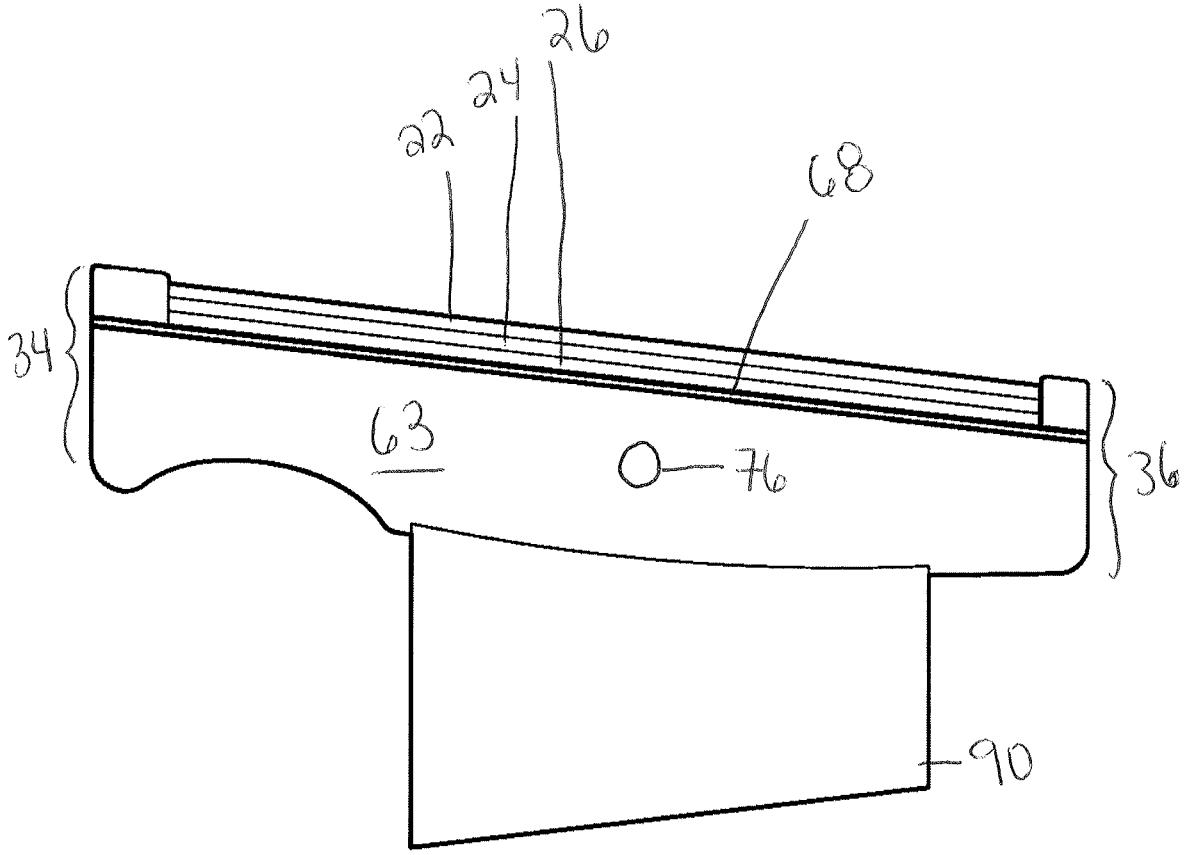
FIG. 15 is a side view of the illuminating pendant affixed to the wearable band of FIG. 12.
Figure 16:
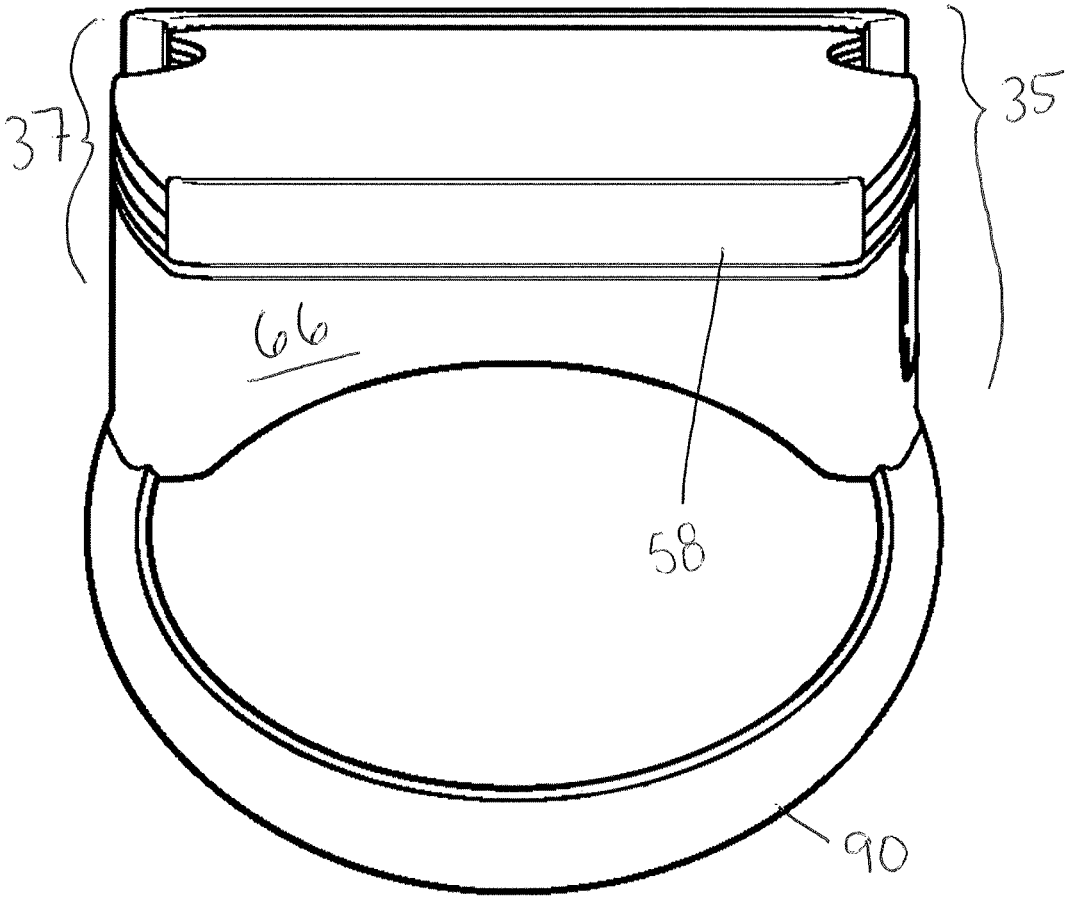
FIG. 16 is a back view of the illuminating pendant affixed to the wearable band of FIG. 12.
Figure 17:
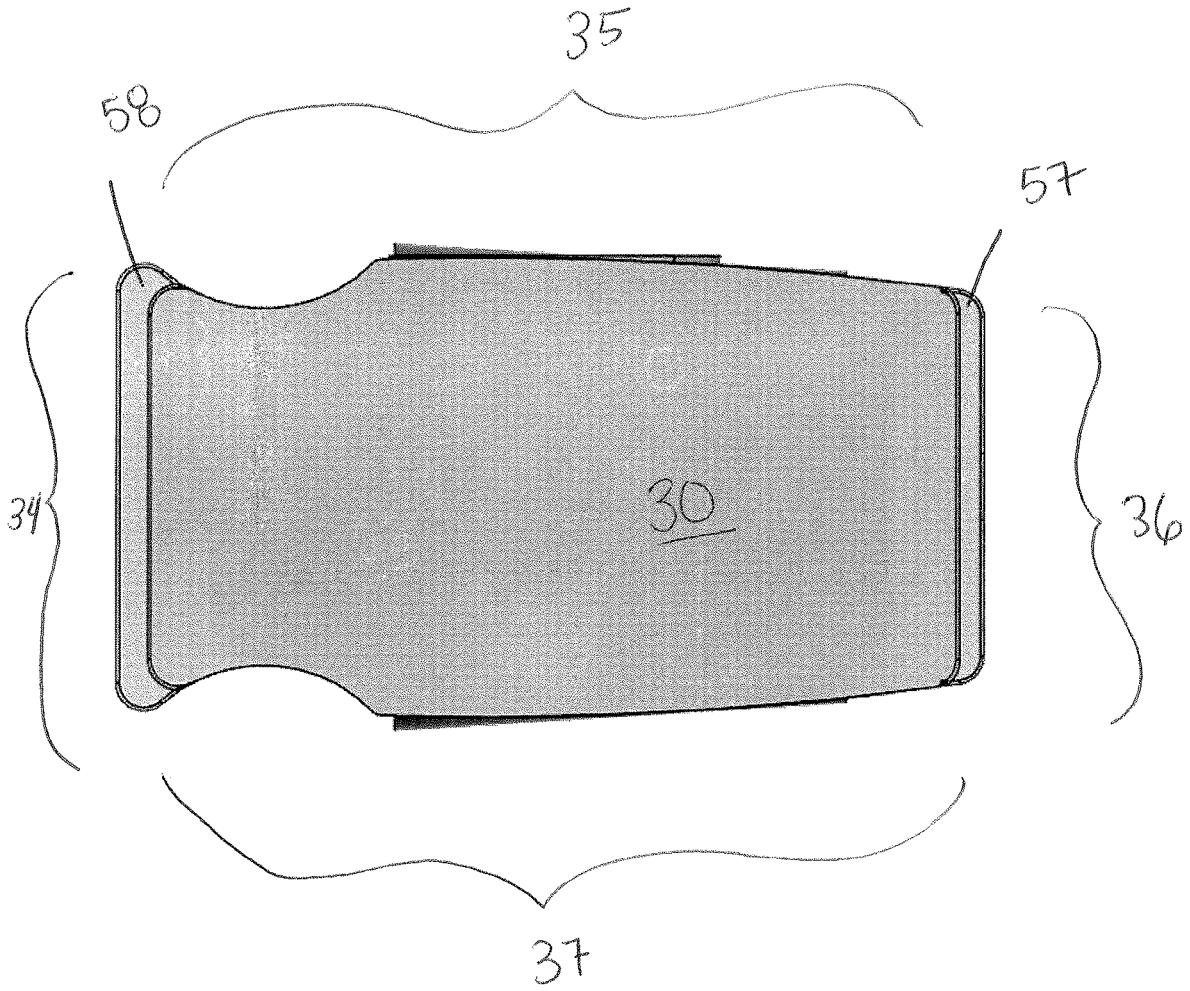
FIG. 17 is a top view of the illuminating pendant affixed to the wearable band of FIG. 12.
Figure 18:
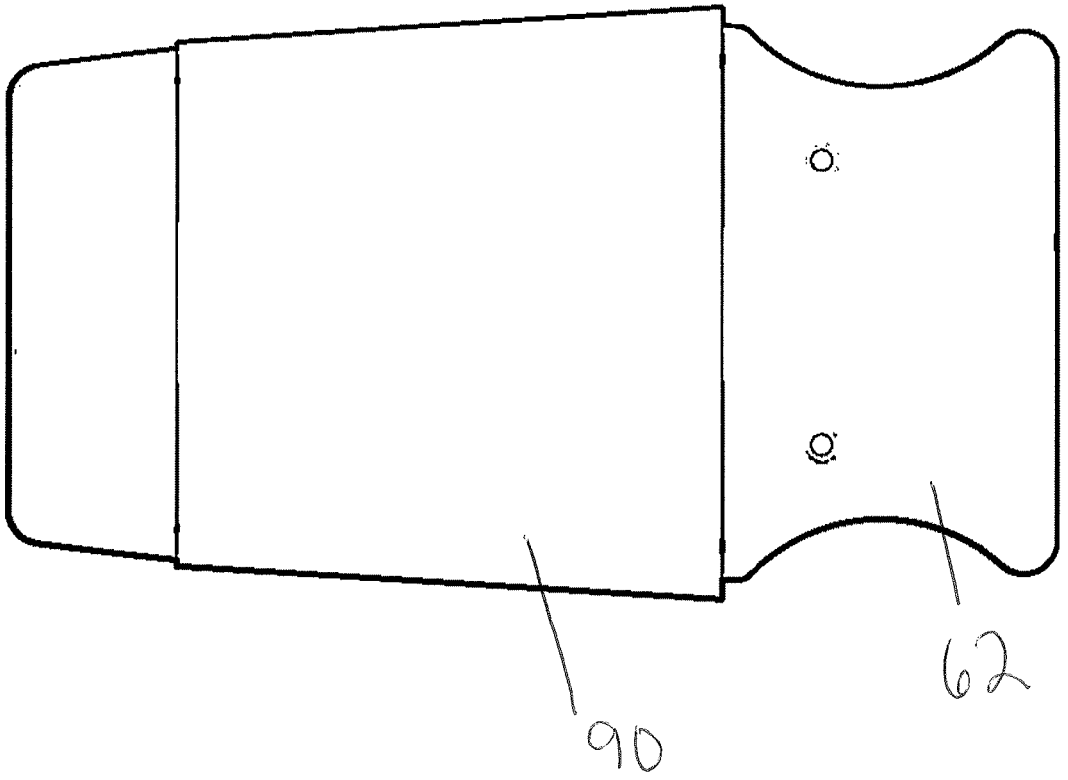
FIG. 18 is a bottom view of the illuminating pendant affixed to the wearable band of FIG. 12.

As shown in FIG. 15, the housing unit 60 also preferably includes a switch 76 connected to the power source or other circuit activating or deactivating the device. In one embodiment, the switch or other circuit for activating or deactivating the device is mechanical, such as a toggle switch, depression switch, three-position switch and other similar mechanical activation assemblies. The switch or other circuit also incorporates activation through embedded instructions and or receipt of activation signals received by the housing unit and included electronics and circuitry. In some embodiments, the control switch is a simple on/off switch; however, in other embodiments the control switch is a three, four, or more position switch that allows a user to customize the order, timing, etc. of the sequence of lights. In addition, or in place thereof, the switch can be replaced with a software or signal controlled switch that is controlled by the internal controller and circuitry of the housing unit and which can communicatively activate by a remote device. The switch or other circuit further incorporate activation through embedded instructions and or receipt of activation signals received by the housing unit and included electronics and circuitry. For example, the housing unit can include a receiver 77 for receiving signals which may activate the illumination features of the device. The switch or other circuit may further incorporate proximity detection devices 83, such as for example RFID or other types of electronics which senses location, proximity or other wireless instructions which would indicate or instruct illumination.

Figure 5:
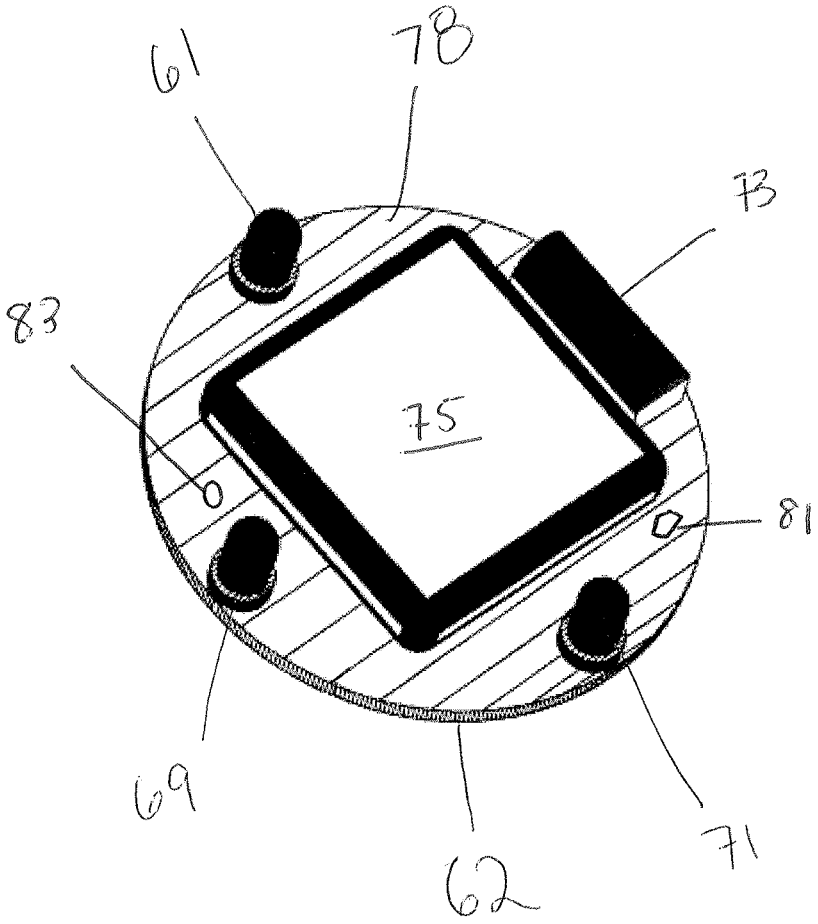
FIG. 5 is a top, perspective partial view of the housing unit of FIG. 1.
Figure 6:
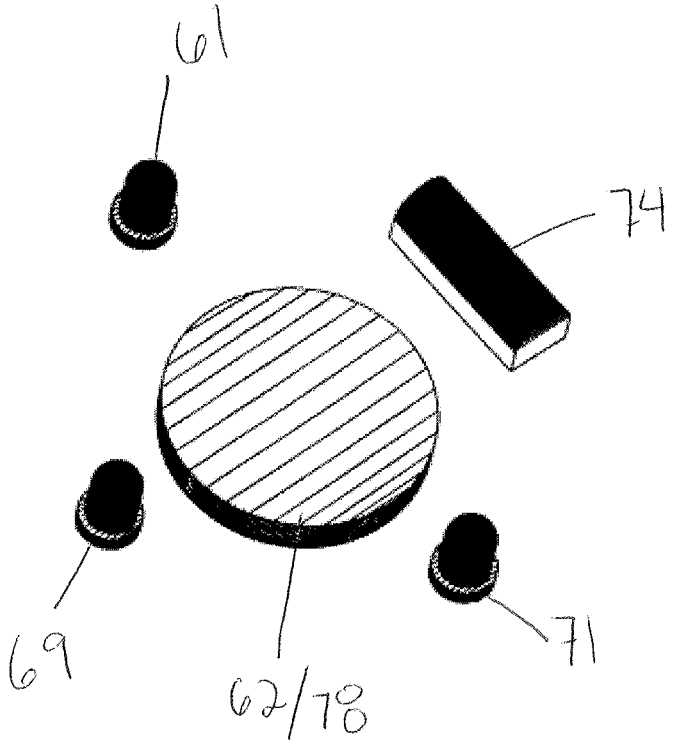
FIG. 6 is a top, perspective view of some contents of the housing unit of FIG. 1.

As shown in FIGS. 5-6, the base 62 of the housing unit is a power cell 78 that provides power to the pendant 10. As shown in FIG. 13, the power source is a battery 80 that is secured in a battery compartment 82 that is located in a side 63 of the housing unit 60. The batteries are secured within the housing unit with a battery cover 84 that is screwed into the side of the housing unit. When the battery compartment door is opened as is illustrated in FIG. 13, the battery is exposed for replacement or servicing. However, this is not intended to be limiting as in other embodiments the battery compartment door is secured through a snapping mechanism and/or a tension mechanism.

As shown in FIG. 5, the housing unit includes a receiver 77 for receiving signals which activates the illumination features of the device or a haptics motor 86 of the device, as shown in FIG. 4. Such devices include instructions and circuitry operable to detect location in respect to a transmitted beacon. For example, the device may automatically activate upon nearing a display, feature, attraction or other location within an amusement park which is transmitting a unique beacon which, when received by the device, causes the device to illuminate in a predetermined manner. Other possible automated instructions include emitting colors, playing predefined audio stored in memory of the device or received by the receiver of the device, playing signals which are streamed and received by the integrated receiver, activating the haptics motor 86, and similar functionality.

In one embodiment, housing unit 60 includes a sender (not shown) that transmits a signal to a display, feature, attraction of other location within an amusement park.

Accordingly, when a user with the device nears a display, feature, attraction or other location which is capable of receiving a unique beacon being sent from the device, the display, feature, attraction etc. illuminates in a predetermined manner. Other possible automated instructions include emitting colors, playing predefined audio stored in memory of the device or received by the receiver 77 of the device, playing signals which are streamed and received by the integrated receiver, and similar functionality.

For example, the device may include a proximity detection device 83 which includes a blu-tooth beacon receiver 77. Upon receipt of a unique beacon signal, the device may be programmed by instructions stored in memory chip 73, as shown in FIG. 4, to activate in a particular manner and/or play specific pre-recorded or streamed audio signals. Alternatively, the device may incorporate RFID detectors wherein the device, upon recognition of a specific RFID signal, begins emitting a predetermined sequence of signals. Other implementations may be implemented such as GPS location detection and determination.

FIG. 7 illustrates the pendant 10 with conductive pins 79 that communicate with other devices. For example, the conductive pins transfer electricity, data and instructions from the pendant to the device into which it plugs. This is one way in which the pendant may be affixed to the wearable band 90. The wearable band may have a corresponding outlet into which the pins plug that may illuminate the wearable band. Moreover, the pendant may be capable of receiving information, data and electricity through these conductive pins from other devices.

Various other features are used in addition to or in place of the various features and aspects described herein. For example, in one embodiment, the illuminated pendant 10 includes a tracking or communication system 81. As shown in FIG. 5, the tracking or communication system includes at least one of: a tracking apparatus; a communication transmitter/receiver device; at least one of a control device; a power source; a controlling, executing, or operating software application that may be utilized to control or operate a control device or communication transmitter/receiver device; an LED light; a switch or a sensor; circuitry to control an LED light; or a translucent material permitting the transmission of light. The tracking apparatus, control device or communication transmitter/receiver device, if present, receive or transmit various electronic signals, such as GPS, Wi-Fi, radio wave, Bluetooth, RFID, proximity detections signals, audio, vibration, light, sound, or infrared. In various implementations, a communication transmitter/receiver device may be utilized and be in electrical communication with or incorporate therein a tracking apparatus and or associated electronics. The communication receiver or communication transmitter may be located within, or attached to, a controller within the housing or in other positions embedded within the device. Additionally, a control device may be utilized and remote from the device, the control device being, in some implementations, a remote control, computer, tablet, smart phone, other smart device, sound device, public address (PA) system, audio system, amplifier system, or one or more speakers. Where present, the remote-control device, which may be defined as an electronic device used to wirelessly control another electronic device, may include a button or other signal that when initiated may send a signal to the communication transmitter or receiver device located in the tracking apparatus or other control electronics of the device. The controlling, executing, or operating software application may, when instructed to, send a signal from the communication transmitter/receiver (located in the control device) to the device tracking apparatus.

In another embodiment, the tracking apparatus 81 may incorporate multiple features noted herein including communication, proximity detection 83, control and location functions. The tracking apparatus may be within the housing unit 60 of the device along with lighting, location, and communication systems. Alternatively, the tracking system may be removably attached via an attaching mechanism (e.g. adhesive, hook and loop, snaps, or the like) to the housing unit. The tracking apparatus may be connected to the power source or the circuit activating/deactivating device (e.g. the on/off switch—not illustrated) used to control the LEDs or the electroluminescence assembly, as described herein. The tracking apparatus may be used to facilitate control of the lighting patterns produced by the LEDs.

For example, the apparatus can receive instructions for a localized and specialized illumination sequence when instructed or when proximity to a particular location is detected. Alternatively, complete illumination instructions may be transmitted by a remote controlling device and received by the device based upon the device's location, time of day, or other requirements or characteristics.

In some embodiments, the tracking apparatus 81 or housing unit 60 also includes a speaker, other audio device, a haptics motor 86 and/or a vibrating device. In this embodiment, the control device sends a signal from the communication transmitter/receiver 77 device located in the control device to the communication transmitter/receiver device located in the tracking apparatus, resulting in the emission of a sound, vibration, or light from the LEDs or electroluminescence assembly. The switch 76 or sensor is capable of being connected to other electronics, and in some instances, is be at activated by motion, acceleration, or impact, which causes the LEDs and control circuitry to remain active for a minimum period of time. Where there is no motion, acceleration, or impact sensed for a minimum period of time, the LEDs and associated control circuitry may enter a low-energy mode to conserve battery; however, sensed motion, acceleration, remote signals or impact may initiate a wake up of the LEDs and associated control circuitry from the low-energy mode.

In other embodiments, a sensor may sense acoustic energy or noise from the environment and convert that acoustic energy or noise into a signal, which may then trigger control of the lighting, or lighting sequence, of the LEDs. The tracking apparatus 81 may, in addition or in place thereof, include various control electronics such as a printed circuit board 74, microcontroller, microprocessor 75, memory chip 73 and associated electronics such as transmitters, receivers 77, GPS, blue tooth communication systems, separate controllers, WiFi communication subsystems and the like. The associated memory may further include stored instructions to control and operate the various features hereof, including stored audio files, video files, pre-recorded materials and illumination cycles and shows as well as other necessary instructions to implement the features outlined herein. As well, such control electronics may be alternatively located within the housing and separate from the features of the tracking apparatus. In some embodiments, a single printed circuit board may combine all features and structures/electronics/circuits. In other implementations, such features may be separately implemented.

As shown in FIGS. 12-18, the illuminated pendant 10 is affixed or otherwise attached to a wearable band 90. The wearable band can be any shape or size depending on user specifications and can be worn around any portion of a user's body. The wearable band is secured around a user's arm for instance via a snap-fit mechanism, but this securement shall not be construed as being limiting as it can secured or affixed through any conventional methods.

In another embodiment (not shown), the housing unit 60 is integrated into the wearable band 90 itself and the illuminated pendant 10 is connected to the wearable band. In this embodiment, the illuminated pendant connects to either the housing unit in the wearable band or connects to the wearable band itself. In this embodiment, the pendant is more easily interchangeable depending on the way in which the pendant is connected to the housing unit or wearable band.

Where present, the wearable band may operate independently from or in conjunction with the pendant 10. In some embodiments, the wearable band 90 includes a light string system, with one or more LEDs 50. In other instances, the wearable band includes an electroluminescence assembly, with an electroluminescent wire, sheet, panel, or tape, and/or an inverter. In some embodiment, the wearable band includes has a power source independent from the power source of the pendant or, in some instances shares a power source with the pendant. This power source includes a battery or other device connected to a printed circuit board. The wearable band is constructed of a pliable or nonpliable material, including but not limited to plastic, thermoplastic, cloth, fabric, wire, rubber, metal, elastic polymer, or other similar material that supports the pendant. The wearable band can also be constructed of any translucent, transparent or other material and may be constructed so as to be flexible or inflexible. In some embodiments, a light string system is constructed within the wearable band and includes an illumination or lamp system electrically connected together with conductive wire or other electrically connective material; each illumination device, lighting or lamp system may further, in some embodiments, include a light assembly and a socket assembly. In various implementations, the light string system and/or the electroluminescence assembly is connected to the LEDs, power source, and associated circuitry used to control the wearable band. The associated circuitry of the wearable band controls the LEDs and/or electroluminescence assembly is also be used to control the light patterns produced by the various illumination devices or lighting units of both the wearable band and the pendant. For example, the light pattern on the wearable band is random, regular, a controlled sequence or pattern, a custom sequence or pattern, and/or sequence or pattern that incorporates constant timing, variable timing, and/or dimming function. In some instances, the pattern or light sequence of LEDs is utilized in addition or in place of the electroluminescence assembly and are utilized to provide illumination which is coordinated with the pattern or light sequences of the pendant.

In the embodiment shown in FIG. 8, the pendant 10 is capable of being magnetically secured to a user's clothing. In this embodiment, the pendant includes a first magnet (not shown) secured thereto, preferably to a back surface 32 of the pendant. This magnet can be secured by any methods, for instance via glue. This magnet is attracted to a second magnet 82 that a user slides behind a shirt or article of clothing. This provides an illusion that the pendant is floating.

It is to be understood that although illustrated in the form of a wearable band 90 and magnetized accessory, the illuminated pendant 10 is not so limited, as the illuminated pendant may be worn by a user (as a necklace, helmet, glasses, bracelet, etc.), attached to other objects, held in a user's hand, used as part of a display, and the like. Furthermore, the illuminated pendant may be formed in any shape, including the shape of eyeglasses, a toy star, toy planet, crystal, sphere, rod, staff, blade, disk, device, wand, multi-sided, polyhedron shape, geometric shape, triangle shape, quadrilateral shape, pentagon shape, hexagon shaped, septagon shaped, octagon shaped, polygon of any number of sides, a commonly recognizable toy(s), or consumer product. In some instances, the illuminated accessory may be in the form of a character, caricature, celebrity or person's shape or image (in whole or part), a logo, symbol, or other recognizable items (e.g. a rocket, airplane, car, animal, bug, plant, rock, rock formation, body part(s), machine, vehicle, boat, alien, wand, sword, knife, gun, pistol, boat, submarine, toy sword, toy vehicle, toy gun, toy shield, toy wand, doll, figurine, action figure, remote controlled vehicle, remote controlled airplane, other remote control toy, hand held toy(s), construction toy(s), toy block(s), accessories, apparel, footwear, hair accessories, jewelry, sports balls or equipment, bike accessories, bike spokes, costumes, headwear, skateboard accessories, wheels, wheel accessories, vehicle accessories, skateboard wheels, snowboard, yo-yo, spinning top, fan, frisbee, nightlight, electronic device, radio, clock radio, mobile phone accessory, and/or desktop device).

While several embodiments of the present invention have been shown and described, it is understood that many changes and modifications can be made thereto without departing from the scope of the inventions as disclosed herein.

The invention claimed is:

1. An illuminating pendant comprising:

a housing unit;

one or more layers of translucent material connected to the housing unit, wherein the one or more layers are collinearly connected; and control circuitry secured to the housing unit and electrically connected to one or more LEDs and to a power source;

wherein the control circuitry comprises a receiver and a proximity detection device; and wherein the control circuitry detects a first signal location proximate to a first proximity beacon and illuminates one or more LEDs in a pattern associated with the first signal location.

2. The pendant of claim 1, wherein the pendant is affixed to a wearable band.

3. The pendant of claim 1, wherein the pendant further comprises a first magnet secured to the housing unit.

4. The pendant of claim 3, wherein the pendant is secured around a wearer's clothing to a second magnet.

5. The pendant of claim 1, further comprising a haptics motor connected to the control circuitry.

6. The pendant of claim 1, further comprising an internal controller connected to the power source, wherein the internal controller is communicatively activated by a remote device.

7. The pendant of claim 1, wherein the control circuitry detects a second signal location proximate to a second proximity beacon and illuminates one or more LEDs in a second predefined sequence associated with the second signal location, wherein the second predefined sequence is different from the first predefined sequence.

8. The pendant of claim 1, wherein the control circuitry controls the one or more LEDs selected from the group consisting of intensity, color temperature, color illumination and timing.

9. The pendant of claim 1, wherein images are etched into one or more layers of the translucent material.

10. The pendant of claim 9, wherein the one or more LEDs associated with the one or more layers of translucent material illuminate in a sequence associated with the first signal location.

11. A pendant comprising:

a housing unit affixed to a wristband;

one or more layers of translucent material connected to the housing unit; and control circuitry secured to the housing unit and electrically connected to one or more LEDs and to a power source;

wherein the control circuitry comprises a receiver and a proximity detection device;

wherein the control circuitry detects a first signal location proximate to a first proximity beacon and illuminates one or more LEDs in a pattern associated with the first signal location;

wherein the control circuitry further detects a second signal location proximate to a second proximity beacon and illuminates the one or more LEDs in a second predefined sequence associated with the second signal location; and wherein the first predefined sequence is different than the second predefined sequence.

12. The pendant of claim 11, wherein the control circuitry controls the one or more LEDs selected from the group consisting of intensity, color temperature, color illumination and timing.

13. The pendant of claim 11, further comprising an audio device and/or a vibrating element electrically connected to the control circuitry, wherein the first predefined sequence associated with the first signal location further comprises activation of the audio device and/or vibrating element.

14. The pendant of claim 11, wherein the power source is further connected to an internal controller, wherein the internal controller is communicatively activated by a remote device.

15. The pendant of claim 11, wherein images are etched into the one or more layers of the one or more layers of translucent material.

16. The pendant of claim 15, wherein the one or more LEDs associated with the one or more layers of translucent material illuminate in a sequence associated with the first signal location so the etched images create a visual animation.

17. A pendant that is magnetically secured around a wearer's clothing comprising:

a first magnet;

a housing unit comprising a front and rear surface, wherein one surface comprises a second magnet securable to the first magnet and the other surface comprises one or more layers of translucent material;

wherein one or more LEDs are associated with the one or more layers of translucent material; and control circuitry secured to the housing unit and electrically connected to the one or more LEDs and to a power source;

wherein the control circuitry comprises a receiver and a proximity detection device;

wherein the control circuitry detects a first signal location proximate to a first proximity beacon and illuminates the one or more LEDs in a pattern associated with the first signal location;

wherein the control circuitry further detects a second signal location proximate to a second proximity beacon and illuminates the one or more LEDs in a second predefined sequence associated with the second signal location; and wherein the first predefined sequence is different than the second predefined sequence.

18. The pendant of claim 17, wherein the power source is further connected to an internal controller, wherein the internal controller is communicatively activated by a remote device.

19. The pendant of claim 17, wherein images are etched into the one or more layers of the one or more layers of translucent material.

20. The pendant of claim 19, wherein the one or more LEDs associated with the one or more layers of translucent material illuminate in a sequence associated with the first signal location so the etched images create a visual animation.

* * * * *